United States Patent [19]

Guinn

[11] Patent Number: 5,074,360

[45] Date of Patent: Dec. 24, 1991

[54] METHOD FOR REPODUCING HYDROCARBONS FROM LOW-PRESSURE RESERVOIRS

[76] Inventor: Jerry H. Guinn, P.O. Box 922, Pampa, Tex. 99066-0922

[21] Appl. No.: 550,567

[22] Filed: Jul. 10, 1990

[51] Int. Cl.[5] ..... E21B 43/17; E21B 43/26; E21B 43/30

[52] U.S. Cl. ..... 166/281; 166/50; 166/245; 166/284; 166/297; 166/308; 175/61; 175/62

[58] Field of Search ..... 166/50, 245, 271, 281, 166/284, 297, 308; 175/61, 62

[56] References Cited

U.S. PATENT DOCUMENTS

| | | | |
|---|---|---|---|
| 3,003,557 | 10/1961 | Huitt et al. | 166/281 X |
| 3,208,537 | 9/1965 | Scarborough | 175/61 |
| 3,282,355 | 11/1966 | Henderson | 175/61 |
| 3,285,350 | 11/1966 | Henderson | 175/62 X |
| 3,386,508 | 6/1968 | Bielstein | 166/272 |
| 3,518,840 | 7/1970 | Mertz | 175/61 |
| 3,635,036 | 1/1972 | Hooper, Jr. | 175/61 |
| 3,835,928 | 9/1974 | Strubhar et al. | 166/308 |
| 3,878,884 | 4/1975 | Raleigh | 166/308 X |
| 3,944,649 | 1/1976 | Pasini et al. | 166/308 X |
| 4,022,279 | 5/1977 | Driver | 166/308 X |
| 4,334,580 | 6/1982 | Vann | 166/268 |
| 4,344,485 | 8/1982 | Butler | 166/50 C |
| 4,368,781 | 1/1983 | Anderson | 166/50 X |
| 4,390,067 | 6/1983 | Willman | 166/245 |
| 4,436,153 | 3/1984 | Carlson | 166/50 X |
| 4,460,044 | 7/1984 | Porter | 166/50 X |
| 4,474,409 | 10/1984 | Trevits et al. | 166/308 X |
| 4,476,932 | 10/1984 | Emery | 166/303 |
| 4,511,000 | 4/1985 | Mims | 166/303 |
| 4,532,986 | 8/1985 | Mims et al. | 166/50 |
| 4,589,491 | 5/1986 | Perkins | 166/308 X |
| 4,605,076 | 8/1986 | Goodhart | 175/61 |
| 4,682,652 | 7/1987 | Huang et al. | 166/263 |
| 4,714,117 | 12/1987 | Dech | 166/50 X |
| 4,850,431 | 7/1989 | Austin et al. | 166/308 |
| 4,867,241 | 9/1989 | Strubhar | 166/308 |
| 4,938,286 | 7/1990 | Jennings, Jr. | 166/50 X |
| 4,951,751 | 8/1990 | Jennings, Jr. | 166/285 |

*Primary Examiner*—George A. Suchfield
*Attorney, Agent, or Firm*—Richards, Medlock & Andrews

[57] ABSTRACT

The present method of drilling, completing and fracturing enhances the production from any reservoir where artificial lift devices are required. However, this method is most suitable for a low pressure, partially depleted subterranean reservoir (50) where secondary recovery methods have proven unsuccessful, or where virgin drainage and pressure has been depleted. The method comprises drilling a substantially horizontal wellbore (20) which penetrates a subterranean reservoir (50) at a degree sufficient to provide drainage through the total vertical section of the reservoir. The horizontal wellbore (20) intersects a vertical wellbore (10) at the lowest vertical depth reached. Fracture stimulation may be applied from either the vertical wellbore, the horizontal wellbore, or both. Moreover, several horizontal well bores (20) can be drilled from a single surface (a) location to intersect other vertically drilled wells (10) or existing producing wells in a reservoir.

21 Claims, 8 Drawing Sheets

METHOD FOR REPODUCING HYDROCARBONS FROM LOW-PRESSURE RESERVOIRS

FIELD OF THE INVENTION

The present invention relates to a method for producing hydrocarbons from an underground reservoir. More specifically, it relates to a method of increasing production of hydrocarbons by connecting a horizontal wellbore to a vertical wellbore, and then stimulating fracture propagation within the reservoir with step-wise application of fracturing techniques along the horizontal wellbore.

BACKGROUND OF THE INVENTION

Traditionally, an underground hydrocarbon reservoir was developed by drilling a vertical well into the formation. If it appeared that the well had located commercial quantities of oil or gas, the well would be completed. Completion usually involves a process known as "setting pipe." "Setting pipe" involves lowering a continuous string of production casing pipe into the hole and cementing it in place. A perforating gun is then lowered into the casing to the depth of the potential petroleum bearing rock. The casing, cement and several inches of rock would then be perforated by explosives in the gun, allowing petroleum in the formation to drain into the wellbore. Sometimes it is necessary to stimulate the well by fracturing the rock hydraulically or through acid treatments.

If the natural pressure within the rocks is high, oil will flow to the surface. If the pressure is low, pumping equipment will be installed to lift the oil to the surface. After some period of time, ranging from several months to many years, the natural or primary pressure in the reservoir rocks may drop to such a level that hydrocarbons will no longer flow into the wellbore at economically producible rates. At that time, secondary recovery techniques may be employed such as water flooding or carbon dioxide flooding of the formation.

More recently, a new technique has been developed to increase production from reservoirs. A wellbore is drilled to match the orientation of the hydrocarbon bearing formation. As these formations are usually horizontal such wells are known as "horizontal wells" or "drain holes." A horizontal well, therefore, is a well which is not vertical and which has been deviated from vertical to increase its contact with hydrocarbon bearing formation. A horizontal well is initiated as a vertical well near the surface. However, as the wellbore's depth increases, it is generally deviated from vertical until its orientation is substantially horizontal thus matching the orientation of the hydrocarbon formation. Although they are more costly and difficult to drill, horizontal wells offer several advantages over vertical wells. One advantage is the increase in direct contact between the horizontal wellbore and the hydrocarbon producing zone or pay zone. The perforated interval for a vertical well is limited to the width of the pay zone. But for a horizontal well, the perforated interval could be many times that of a vertical wellbore. Furthermore, this increase in length allows for an increased number of potential fracture locations. For example, a vertical well might only be fractured in three locations, while a horizontal well could be fractured at, for example, up to fifteen locations.

Horizontal wells, however, have several disadvantages. A first disadvantage involves the ability to lift fluid out of a horizontal wellbore. Producing a low pressure reservoir through a horizontal or near horizontally drilled wellbore with conventional artificial lift equipment is either impossible or very expensive. Lift equipment, such as "roller rods", can only produce from the highest or a higher point in the wellbore. Even then, some reservoir pressure is required to raise the hydrocarbons to that point.

A second disadvantage involves fracture stimulation along a horizontal wellbore. Hydraulic fracture stimulation of a conventionally drilled drain hole can only be applied along the single wellbore from a single surface opening. This requires expensive mechanical isolation for creating and fracturing of multiple fractures over the length of the drain hole. Also, fracturing rates are limited to the capacity of one wellbore and are often inadequate for stimulation of the large amount of reservoir requiring multiple fracture stimulation. Furthermore, fracture treatments often "screen out" in the long horizontal drain hole due to the large surface area encountered and inadequate fracturing rates and pressure at the formation fracture point. Besides the difficulty of supplying adequate stimulation fracturing rates and pressure, horizontal wells create difficulties in controlling fracturing rates and pressures. For example, when drain holes are completed with uncemented slotted liners, multiple stage fracture treatments using diverting agents are required to open multiple fractures. Diverting agents and volumes are difficult to calculate and control over these long sections where that control is critical for multiple fracture initiation and access to the reservoir is only from one end of the drain hole.

A number of patents have issued on methods of producing hydrocarbons incorporating horizontal wellbores. For example, U.S. Pat. No. 4,682,652 to Huang et al. discloses a method of producing hydrocarbons through successively perforated intervals of a horizontal well between two vertical wells. The method requires a horizontal well to be drilled under the vertical wells. This horizontal well is then perforated along its length. The first vertical well is injected with thermal fluid. Hydrocarbons are produced first through the perforations closest to said vertical well, and later through successive perforations even farther from the first vertical well. Ultimately, hydrocarbons are produced by the second vertical well. While this method coordinates the use of horizontal wells with existing vertical well patterns, the vertical wells do not contribute to the fracturing of the formation surrounding the horizontal well.

U.S. Pat. No. 4,532,986 to Mims et al. discloses a method of completing a well involving the intersection of a horizontal well with a vertical well. The completion includes a well liner which lies in a generally horizontal disposition within a hydrocarbon holding substrate to define the primary well. A secondary well which extends to the surface intersects the primary well. A stream of hot stimulating fluid is injected into the primary well from the secondary well. A flow diverter is positioned in the primary well to urge the stimulating fluid into the substrate at desired locations. The fluid creates a heated path along which viscous oil may flow. Mims et al. does not disclose a method of fracturing the formation surrounding the primary well. Nor does Mims et al. disclose a method of stimulating a well simultaneously from both well openings.

U.S. Pat. No. 4,390,067 to Willman discloses a method for treating a field containing viscous oil for subsequent production. The method involves drilling a horizontal well within the oil-bearing stratum and heating the oil in the vicinity of the horizontal well to produce a hot liquid corridor. The horizontal and vertical wells may be connected in various configurations to effectively displace a high percentage of oil in a particular field.

In sum, many older producing fields, where reservoir pressure has been depleted, cannot economically support the drilling of many additional vertical wells between the existing wells in order to produce the remaining hydrocarbons. Moreover, horizontally drilled drain holes are difficult to produce where reservoir pressure is low or depleted and will not lift fluid to a point high enough to produce economically. A need exists for a method of producing low pressure reservoirs with horizontal wells which overcomes the difficulties encountered in production and stimulation of the horizontal well.

SUMMARY OF THE INVENTION

This invention relates to a novel method of producing hydrocarbons from underground formations. The method is particularly suited to increase recovery of hydrocarbons from formations in which natural reservoir pressure is low or has been depleted. The method is also well suited for formations in which conventional secondary recovery methods have been ineffective or uneconomical. In one embodiment of the invention, a substantially horizontal wellbore is drilled so as to intersect a pre-existing, substantially vertical wellbore. Such a horizontal wellbore is initially drilled vertically from the surface, but as its depth increases, the wellbore is deviated from vertical until it attains a substantially horizontal orientation while penetrating the hydrocarbon bearing formation. Thus a substantial length of the horizontal wellbore is in contact with the hydrocarbon bearing formation.

Upon penetrating the upper boundary of the hydrocarbon stratum, the horizontal well or "drain hole" is aimed, by means of directional drilling, towards the vertical well which has penetrated the entire width of the reservoir. The drain hole is directed to intersect the vertical well at the lowest point desired within the reservoir. The path of the drain hole as it travels through the oil bearing stratum need not be straight. Indeed an S-shaped or complex path would create additional wellbore surface area into which oil may flow. Intersection with the vertical well is easier when the well has been "shot" thus increasing its diameter. However, if the horizontal well misses the vertical well by even as much as several feet, a path between the two wellbores may be created by high pressure fluids applied through either wellbore. Thus, the wellbores will intersect after this displacement.

Once the horizontal well has intersected the vertical well, the horizontal well is completed and then perforated. Perforation typically involves exploding a charge within said completed portion. This charge should be sufficient to create openings in the completion casing and into the surrounding reservoir. The debris caused by the charge must then be cleaned from the wellbore. Oil will flow into the horizontal well and gravity will urge the flow towards the vertical well. Conventional lift equipment can then bring the oil to the surface. If the formation's permeability is to be increased, fracturing can be accomplished by step-wise application of hydraulic pressure supplied through either or both wellbores. In other words, the pressure may be applied from the horizontal well and the vertical well either simultaneously or alternatively.

In another embodiment of the invention, a substantially vertical well is drilled to intersect a preexisting substantially horizontal well. In this case, a horizontal well has been used to produce oil from a formation until the natural reservoir pressure is low or depleted. A vertical well is drilled to intersect the horizontal well at a point in the formation. Again, should the vertical well miss the horizontal well by even several feet, a path may be created between the two wellbores by high pressure fluids applied through either wellbore. Further, fracturing can be accomplished by application of hydraulic pressure through either or both wellbores. Hydrocarbons are then produced from either or both wells.

In another embodiment, the same method is used in a field systematically drilled with multiple vertical wells. A single central site is chosen within the field. Next, a horizontal well is drilled from that point to an adjacent vertical well. The same procedure is repeated, creating another horizontal well to another vertical well. This can be repeated, creating a star-pattern of horizontal wells. In another embodiment of this method, multiple surface sites are chosen. Multiple horizontal wells can be drilled from each location, producing a criss-cross pattern of horizontal wells. The same advantageous fracturing attributes of this method are equally applicable to these later-described multiple well techniques.

BRIEF DESCRIPTION OF THE DRAWINGS

For a more complete understanding of the present invention, and for further details and advantages thereof, reference is now made to the following Detailed Description taken in conjunction with the accompanying drawings, in which.

DETAILED DESCRIPTION OF THE INVENTION

Figure 1:
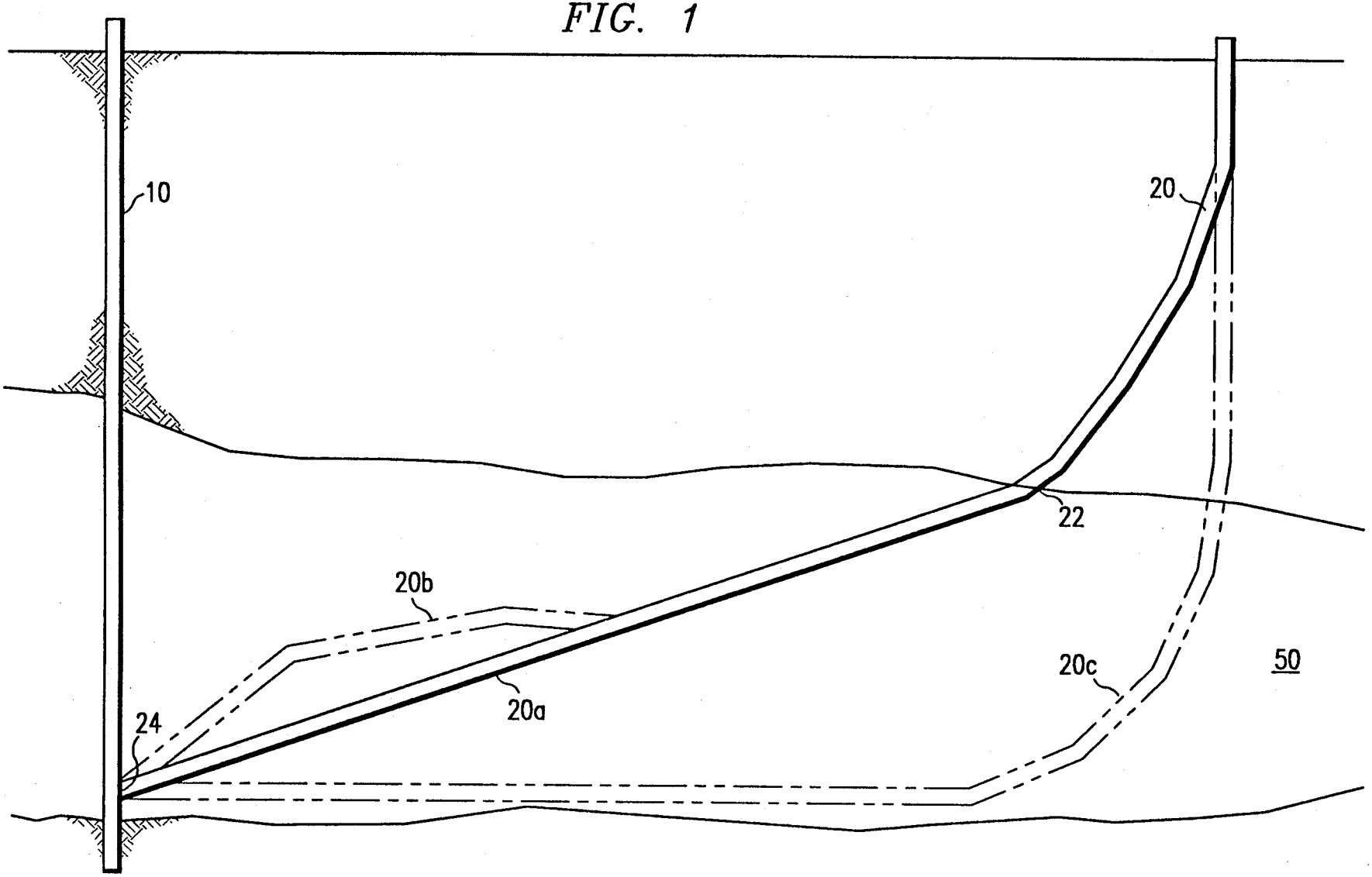
FIG. 1 schematically illustrates the concept of intersecting a horizontal well with a vertical well.

The present invention is a method of producing hydrocarbons from an underground formation that overcomes many of the disadvantages found in the prior art. Referring to FIG. 1, vertical wellbore 10 is drilled through the subterranean reservoir 50. Horizontal wellbore 20 is drilled using horizontal drilling technology creating a drain hole which intersects the reservoir at point 22, then laterally drilled to intersect vertical wellbore 10 at point 24, the lowest desired point reached in the drain hole. The horizontal wellbore 20 starts as a vertical well, but deviates from vertical as the well deepens. In practice, a well may be deviated as desired, but generally it is deviated 8°-20° for every 100 feet of depth. As illustrated, the drain hole 20 can be designed as a direct lateral drain hole 20*a*, an S-curve configuration, 20*b*, or a substantially horizontal well 20*c*. The path chosen should maximize wellbore surface area contact with hydrocarbon bearing rock. Either the vertical wellbore 10 or horizontal wellbore 20 could be an existing producing well where production has depleted reservoir pressure and secondary recovery has proven ineffective, leaving the well near or past economic producing limits. If the horizontal well misses the vertical well, or vice versa, a path may be created between the two wellbores by high pressure fluids applied through either wellbore. Thus, the terms intersecting or intersection also include those situations where such a path must be created.

Figure 2A:
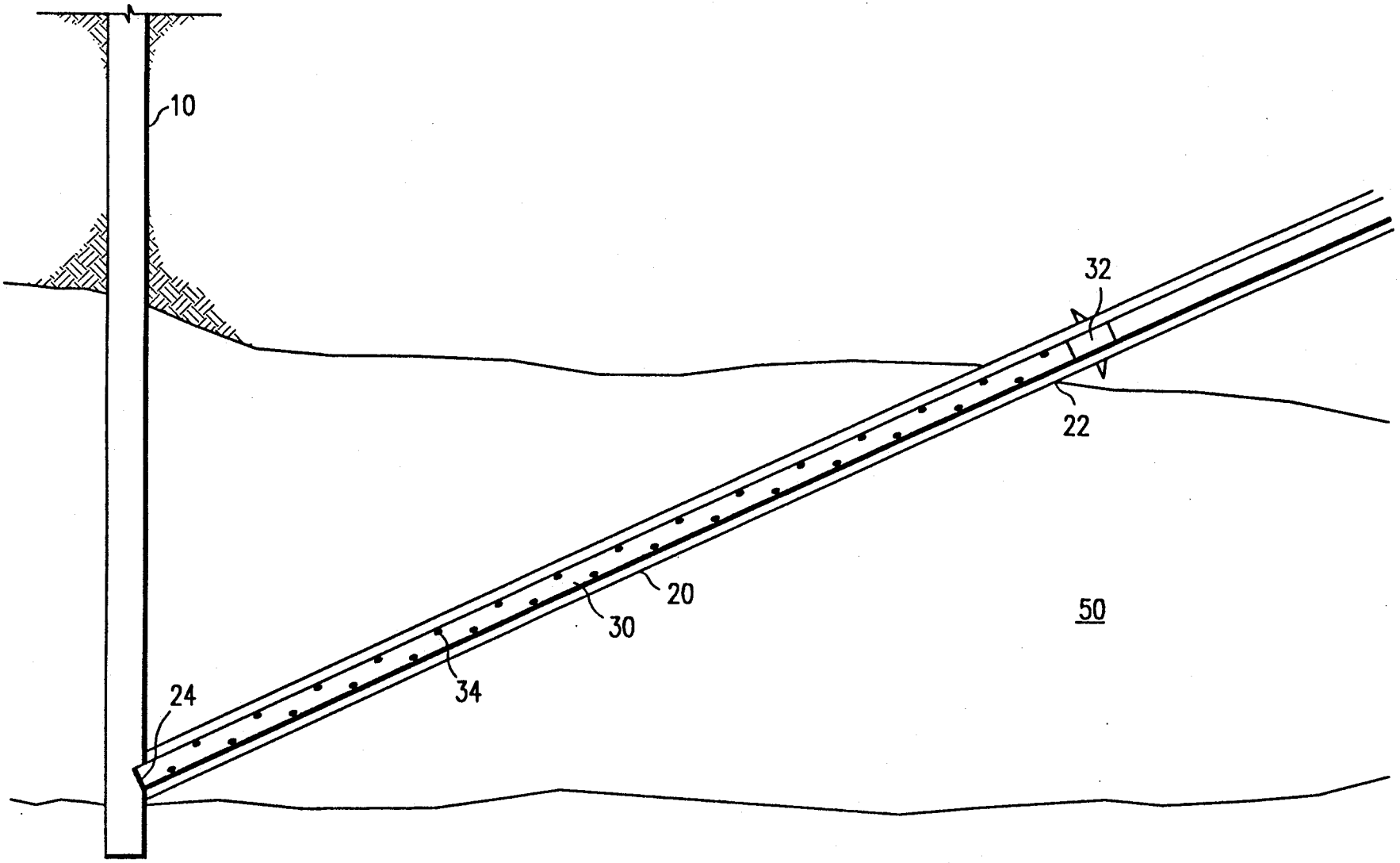
FIG. 2*a* illustrates a method of completing the horizontal well with a slotted liner.
Figure 2B:
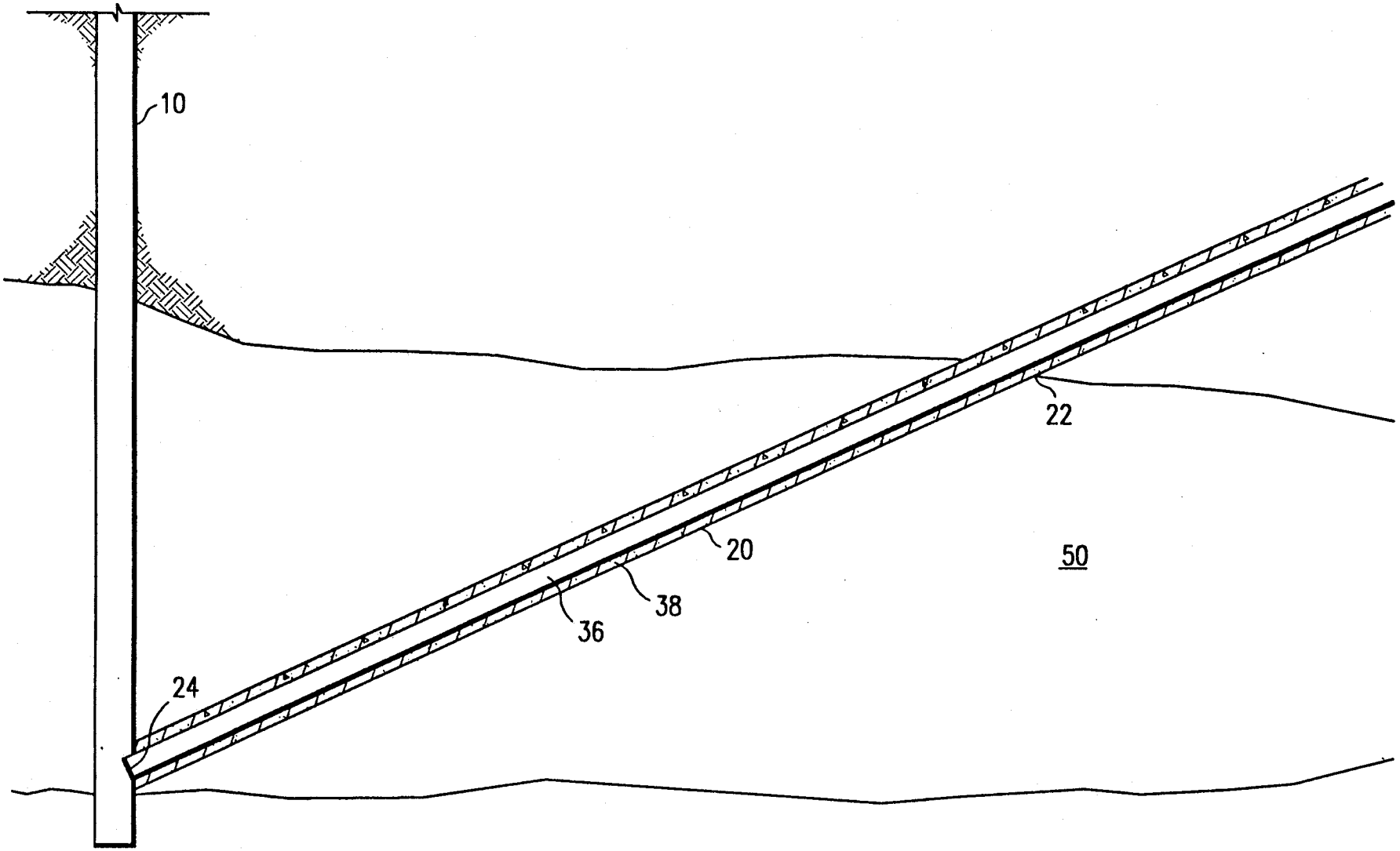
FIG. 2*b* illustrates a method of completing the horizontal well with casing cemented in place.
Figure 2C:
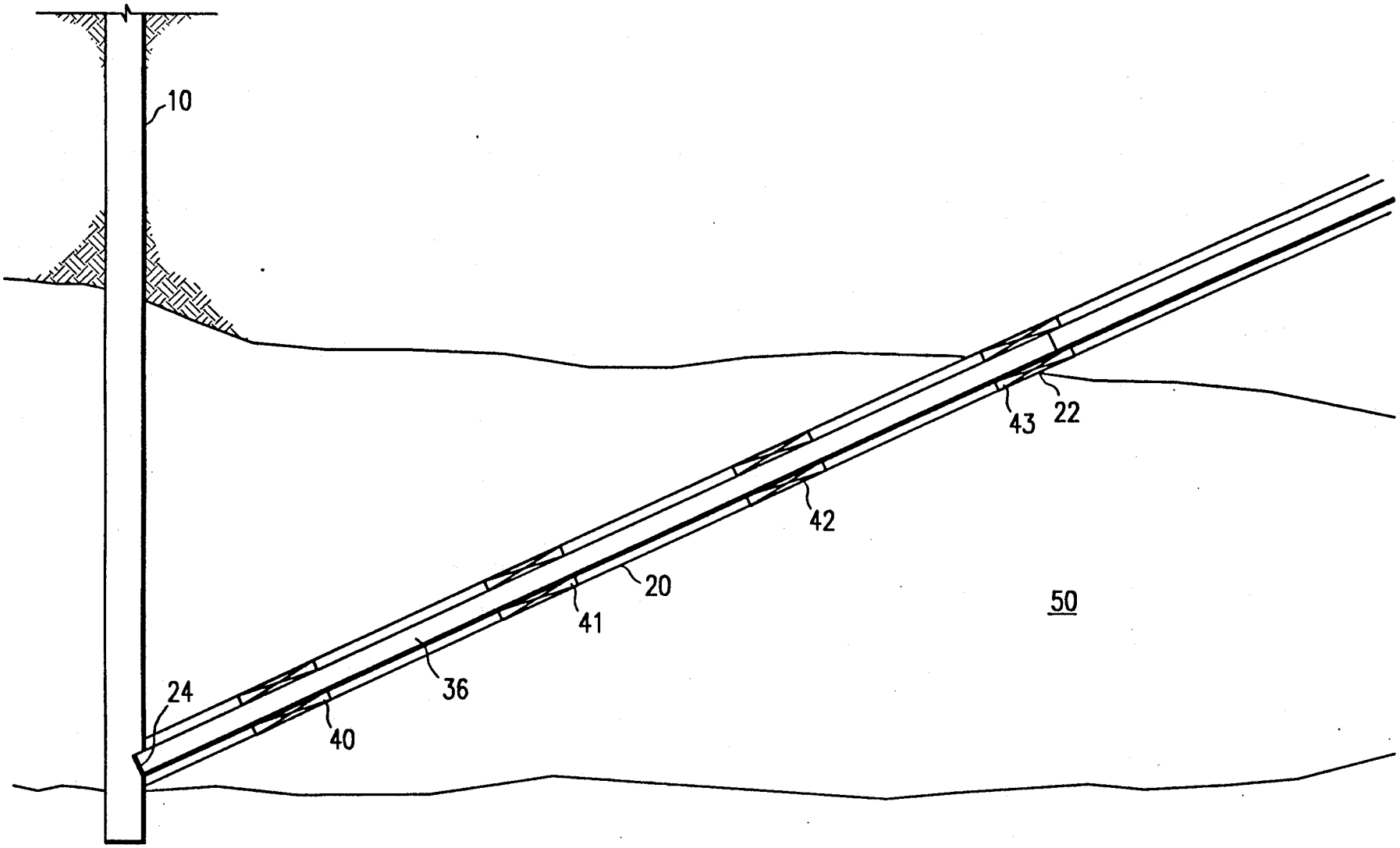
FIG. 2*c* illustrates a method of completing the horizontal well in which formation packers are cemented in place along the length of the casing.

Referring to FIGS. 2*a*, 2*b*, and 2*c*, various methods of completing horizontal wellbore 20 are illustrated. After wellbore 10 and wellbore 20 have been drilled, several types of casing or open hole preparation of the drain hole for completion are possible. FIG. 2*a* illustrates a hole completion in which a slotted liner 30 is run into the drain hole 20. The liner 30 is hung uncemented from liner hanger 32. In a preferred embodiment, the liner 30 extends the entire length of drain hole 20 from reservoir intersection point 22 to vertical well intersection point 24. The liner is perforated with slots 34. FIG. 2*b* illustrates an alternative method of completing the horizontal well 20. Casing 36 is run through the drain hole 20 and conventionally cemented in place. Casing 36 and cement 38 may extend the entire distance of the well 20 as shown. Both the casing 36 and cement 38 is then perforated by such conventional means as a perforating gun. FIG. 2*c* illustrates yet another alternative method of completing the horizontal well 20. Casing 36 is run through the drain hole 20 and formation packers 40, 41, 42 and 43 are then cemented in place in spaced apart relationship. Fractures are subsequently initiated along drain hole 20 between packers 40, 41, 42 and 43.

Figure 3A:
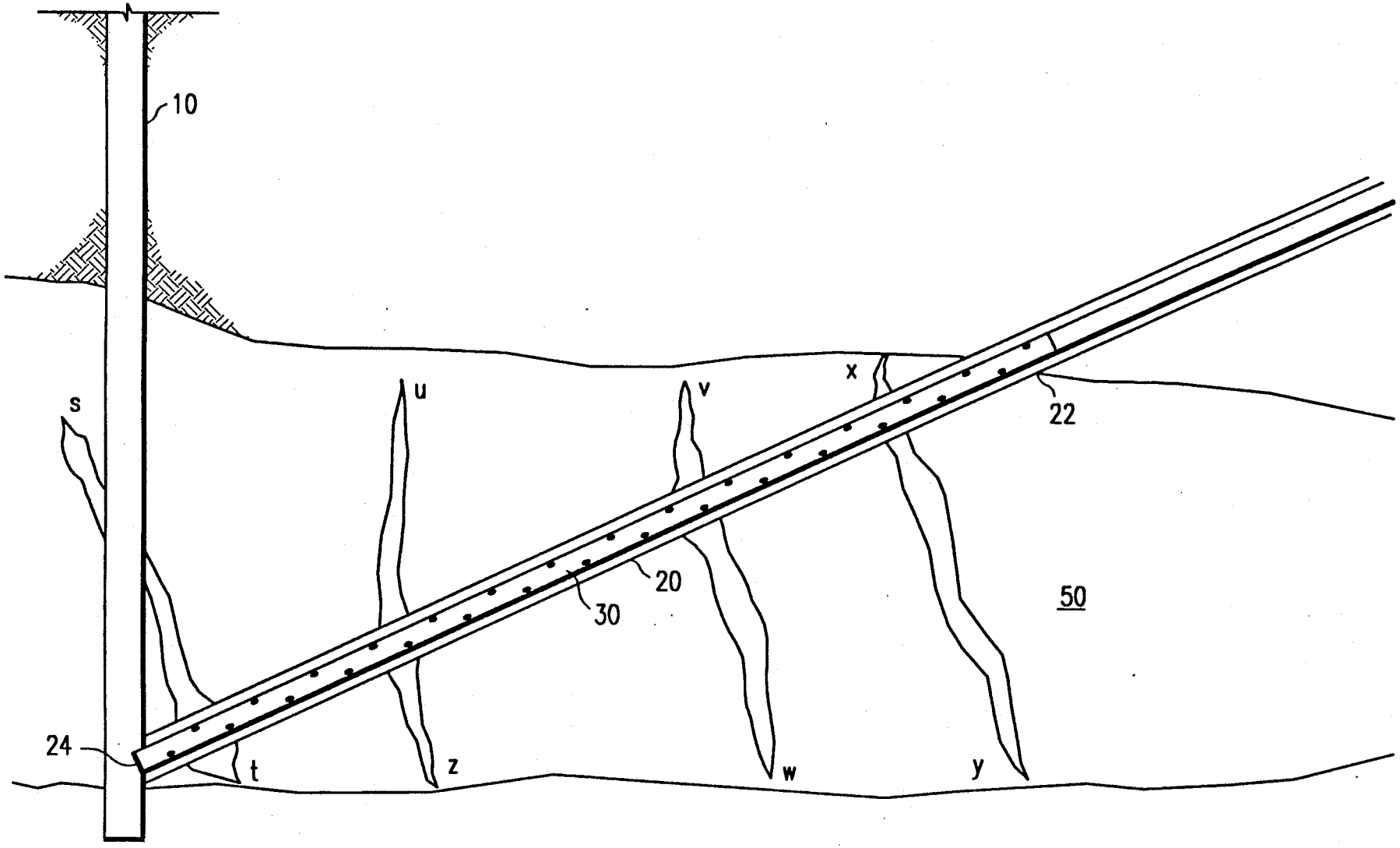
FIG. 3*a* illustrates fracturing the formation around a horizontal well completed as illustrated in FIG. 2*a;*
Figure 3B:
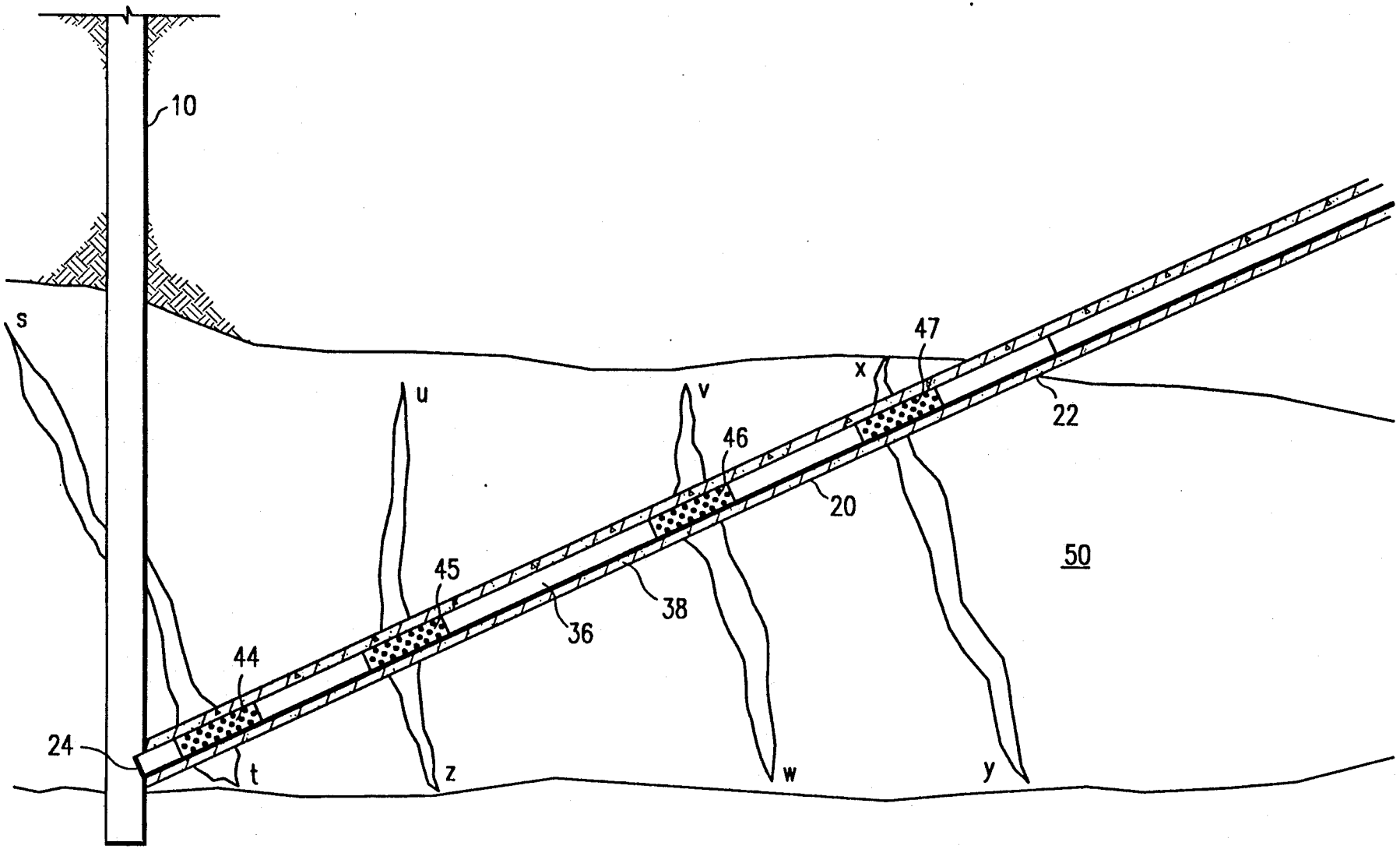
FIG. 3*b* illustrates fracturing of a formation around a horizontal well completed as shown in FIG. 2*b;*
Figure 3C:
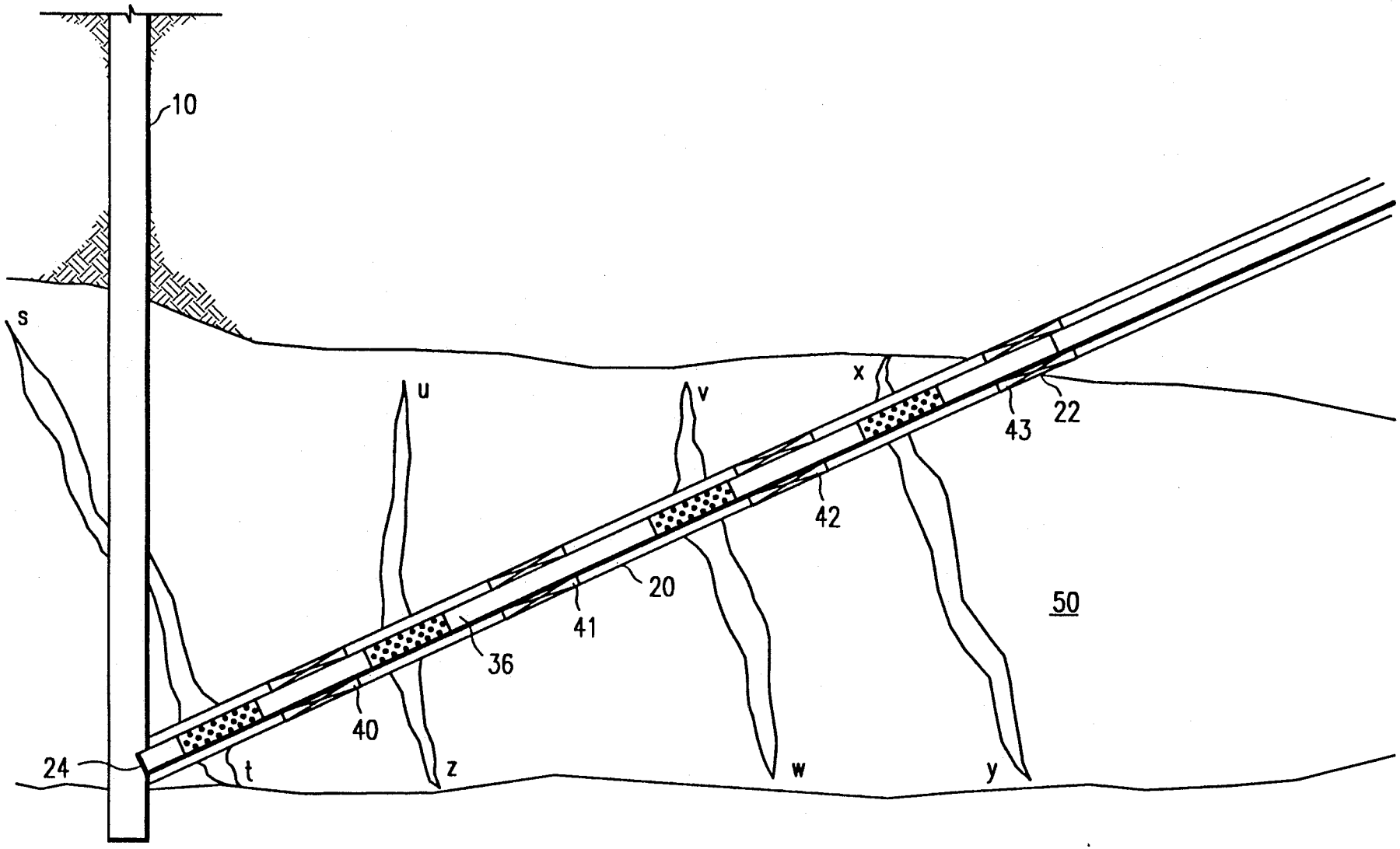
FIG. 3*c* illustrates fracturing of a formation around a horizontal well completed as shown in FIG. 2*c;*

Referring to FIGS. 3*a*, 3*b*, and 3*c*, various methods of fracturing the formation around wellbore 20 are illustrated. After wellbore 10 and wellbore 20 have been drilled and prepared for completion, fracture treatment design is done to optimize fracture stimulation utilizing the preferred embodiment. As shown in FIG. 3*a*, for a drain hole that has been prepared for completion with a slotted liner 30 and no cementing (as shown in FIG. 2*a*), the following procedure would be followed. First, after a fracture u-z has been initiated, fracture treatment can be performed down both wellbore 10 and wellbore 20 simultaneously at an injection rate adequate to fracture u-z to the desired length. Second, using a higher injection rate to create additional differential pressure a second fracture v-w is initiated and fractured to the desired length. After fractures u-z and v-w have been initiated and fractured to the desired length, a third fracture treatment stage is performed utilizing diverting material pumped through horizontal wellbore 20 to create additional differential pressure initiating a third fracture x-y. After the fracturing of x-y has been completed, diverting material is pumped through wellbore 10 to temporarily stop flow into fractures u-z, v-w and x-y, thus increasing pressure to initiate fracture s-t. Diverting material is typically capable of passing through the perforated casing or slotted liner and removably lodging against the fracture face. Fracturing is then performed only through wellbore 10 to avoid disturbing the diverting material covering fractures u-z, v-w and x-y, on the opposite end of the drain hole. This procedure may be repeated until multiple fractures have been initiated and fractured.

Referring to FIG. 3*b*, casing 36 has been perforated at points 44, 45, 46, and 47 at anticipated fracture planes s-t, u-z, v-w, and x-y. Fracture treatment can then be performed through either or both wellbore 10 and wellbore 20. First, fractures s-t, u-z, v-w, and x-y are initiated with a breakdown fluid. Next, a fracturing fluid is pumped into wellbore 20. If very high pressures or pumping rates are desired, fracture fluid may be pumped into both wellbores. The fracturing fluid will extend a single fracture, for example, fracture u-z. Next, a second application of breakdown fluid is pumped into wellbore 20. This second application contains diverter ball sealers which seal off fracture u-z by stopping flow through perforations at point 45. When these perforations are sealed off, the pressure rises in wellbores 10 and 20. Concurrent with the pressure rise, fracturing fluid is again pumped into wellbore 20 to extend a second fracture such as fracture v-w. Again, a breakdown fluid containing diverter ball sealers is pumped into wellbore 20. In an alternative embodiment, a diverter material may be placed in the breakdown fluid rather than diverter balls. With either embodiment, pressure within wellbore 20 increases. This procedure is repeated until, as illustrated, each initiated fracture is extended.

Pumping of fluid through both wellbores 10 and 20 will clear the wellbore of fracturing fluid. Thus, only breakdown fluid has access to perforation points when diverter ball sealers are pumped through wellbore 20. This prevents fracturing fluid from migrating down wellbore 20 and screening out a newly extended fracture. In conventional diverter ball sealer treatments, the ball sealers are dimensioned so as to seal the perforations in casing 36, thereby preventing migration of subsequent fracture fluid into the completed fracture.

FIG. 3*c* illustrates a drain hole that has been prepared for completion by setting a liner or casing 36 through the wellbore with permanent formation packers 40 to isolate the reservoir where fractures are to be initiated (as shown in FIG. 2*c*). Fractures can be isolated mechanically and fractured from either wellbore 10 or horizontal wellbore 20 or both as previously described. All fractures can be opened and multiple stage fracture treatments done with diverting agents as shown in FIG. 3*a* or FIG. 3*b*.

Figure 4:
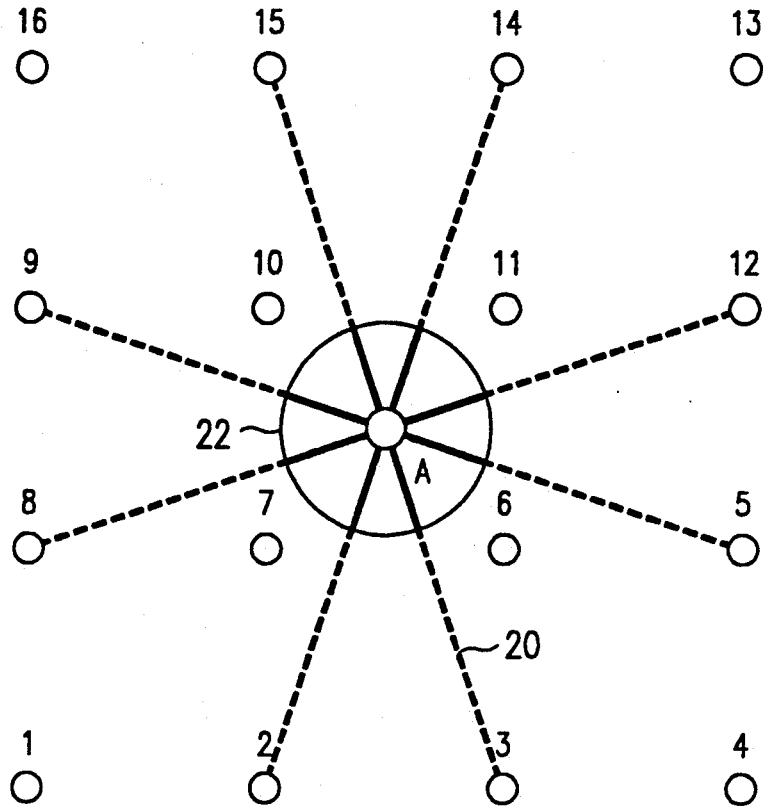
FIG. 4 illustrates a preferred pattern of drilling multiple horizontal wells from a central point to connect with multiple vertical wells.

FIG. 4 is a top view of a preferred drilling pattern for a formation which has already been produced by a number of vertical wells, 1 through 16, subject to spacing rules. A central drill site A is chosen in the center of the grouped vertical wells. A horizontal well 20 is then drilled from site A until it intersects an exterior vertical well, for example well 15. A number of such horizontal wells 20 can be drilled, thus producing a star-shaped pattern. Each horizontal well increases production from the formation by providing more wellbore surface area in contact with the hydrocarbon deposits. The circle 22 represents the location at which the horizontal well 20 intersects the top of the formation 50.

Figure 5:
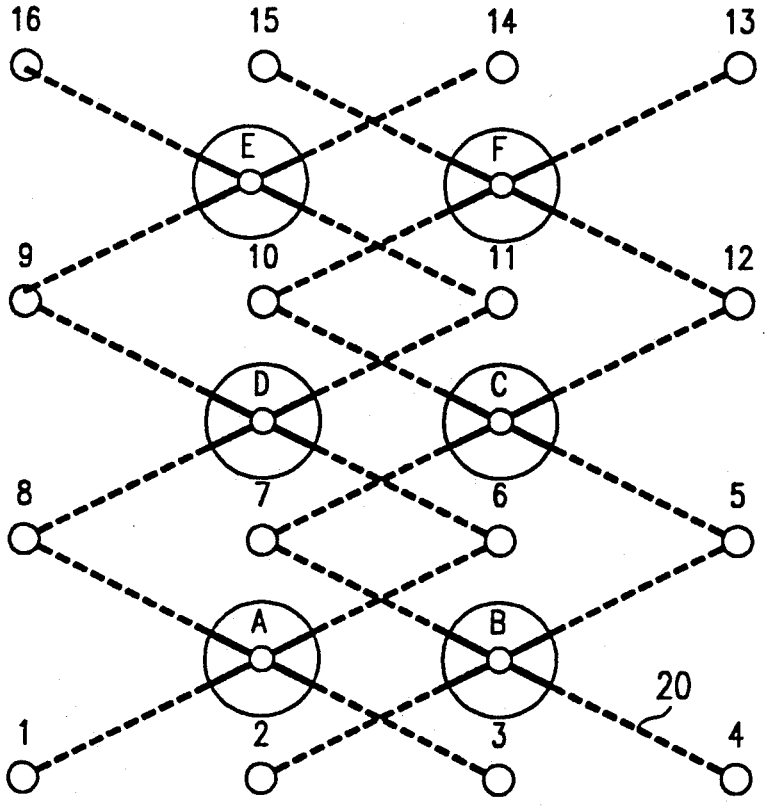
FIG. 5 illustrates another preferred pattern of drilling multiple horizontal wells originating from several surface locations to connection with multiple vertical wells.

FIG. 5 is a top view of an alternative drilling pattern for a formation which has already been produced by a number of vertical wells, 1 through 16. Multiple drill sites, A through F, are chosen. Multiple horizontal wells 20 are then drilled from the drill sites to the vertical wells. For example, four horizontal wells may be drilled from drill site E, each aimed for a different vertical well. In this case wells would be completed between site E and wells 9, 11, 14 and 16.

Although preferred embodiments of the invention have been described in the foregoing Detailed Description and illustrated in the accompanying drawings, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications and substitutions of parts and elements as fall within the spirit and scope of the invention.

I claim:

1. A method for producing hydrocarbons from an underground reservoir into which at least one vertical well penetrates, comprising:

(a) drilling a substantially horizontal well within the reservoir, said horizontal well intersecting at least one of said at least one vertical well; and (b) producing hydrocarbons without artificially driving the hydrocarbons from the reservoir from either said vertical well or said horizontal well wherein said producing hydrocarbons further comprises fracturing said horizontal well through the application of fluid pressure from both the vertical well and horizontal well simultaneously or alternatively.

2. The method of claim 1, wherein said producing hydrocarbons comprises completing said horizontal well.

3. The method of claim 1, wherein said producing hydrocarbons further comprises pumping to the surface the hydrocarbons which drain into the horizontal well.

4. The method of claim 1, wherein said producing hydrocarbons further comprises pumping to the surface the hydrocarbons which drain into the vertical well.

5. A method of producing hydrocarbons from an underground reservoir into which at least one horizontal well penetrates, comprising:

(a) drilling a substantially vertical well into said reservoir, said vertical well intersecting said horizontal well; and (b) producing hydrocarbons without artificially driving the hydrocarbons from the reservoir from either said vertical well or said horizontal well.

6. The method of claim 5, wherein said producing hydrocarbons comprises completing said horizontal well.

7. The method of claim 5, wherein said producing hydrocarbons further comprises fracturing said horizontal well through the application of fluid pressure from both the vertical well and horizontal well simultaneously or alternatively.

8. The method of claim 5, wherein said producing hydrocarbons further comprises pumping to the surface the hydrocarbons which drain into the horizontal well.

9. The method of claim 5, wherein said producing hydrocarbons further comprises pumping to the surface the hydrocarbons which drain into the vertical well.

10. A method for producing hydrocarbons from an underground reservoir, comprising:

(a) drilling a substantially vertical well through the reservoir;

(b) drilling a substantially horizontal well located within the reservoir, said horizontal well intersecting said vertical well;

(c) fracturing the reservoir surrounding the horizontal well; and (d) producing hydrocarbons from said horizontal well.

11. The method of claim 10, wherein said drilling a substantially horizontal well comprises deviating a vertical well as it deepens until its orientation is substantially horizontal.

12. The method of claim 10, wherein said fracturing comprises pumping fracturing fluid from either the vertical well, the horizontal well, or both, at pressures sufficient to fracture the reservoir.

13. The method of claim 10, wherein said fracturing comprises the step-wise application of high-pressure fluids to specific locations along the length of the horizontal well within said reservoir to initiate and propagate fractures in said reservoir said step-wise application comprising:

(a) perforating a casing along the length of said horizontal well;

(b) pumping a first application of breakdown fluid into the horizontal well to initiate at least one fracture along the length of said horizontal well;

(c) pumping fracturing fluid into the horizontal well from both the horizontal well and the vertical well either simultaneously or alternatively to extend a first fracture further into the reservoir;

(d) pumping a next application of breakdown fluid into the horizontal well, said next application of breakdown fluid into the horizontal well, said next application further including either diverter ball sealers or diverting material, said diverter ball sealers lodging within the perforations in said casing, said diverter material passing through said perforations and removably lodging against said fracture face; and (e) repeating steps (c) and (d) until the desired number of fractures are achieved.

14. The method of claim 10, wherein said producing hydrocarbons comprises pumping the hydrocarbons which drain into the horizontal well to the surface through the vertical well.

15. A method for producing hydrocarbons from an underground hydrocarbon reservoir in which natural pressure has been partially depleted by existing vertical wells, comprising:

(a) drilling a horizontal well, a portion of which traverses the reservoir, the end of which intersects an existing vertical well;

(b) completing the portion traversing the reservoir;

(c) fracturing the reservoir surrounding said portion at intervals with step-wise application of fracturing fluids along its length said step-wise application comprising:

(i) perforating a casing along the length of said horizontal well;

(ii) pumping a first application of breakdown fluid into the horizontal well to initiate at least one fracture along the length of said horizontal well;

(iii) pumping fracturing fluid into the horizontal well from both the horizontal well and the vertical well either simultaneously or alternatively to extend a first fracture further into the reservoir;

(iv) pumping a next application of breakdown fluid into the horizontal well, said next application of breakdown fluid into the horizontal well, said next application further including either diverter ball sealers or diverting material, said diverter ball sealers lodging within the perforations in said casing, said diverter material passing through said perforations and removably lodging against said fracture face; and (v) repeating steps (iii) and (iv) until the desired number of fractures are achieved; and (d) pumping hydrocarbons which drain into said portion to the surface.

16. The method of claim 15, wherein completing said reservoir traversing portion comprises:

(a) running a slotted liner into said portion; and (b) hanging the liner on a liner hanger.

17. The method of claim 15, wherein said completing said reservoir traversing portion further comprises:

(a) running a casing into the traversing portion;

(b) cementing the casing to said portion; and (c) perforating said portion at intervals along its length.

18. The method of claim 15, wherein said completing the reservoir traversing portion further comprises:

(a) running a casing into the traversing portion; and (b) cementing formation packers at positions between the casing and the traversing portion; and (c) perforating said portion at intervals along its length.

19. The method of claim 17 or 18, wherein said perforating the reservoir traversing portion comprises:

(a) exploding a charge within said completed portion, said charge being sufficient to create openings in the completion casing and into the surrounding reservoir thus creating debris; and (b) cleaning the debris from the reservoir traversing portion.

20. A method for producing hydrocarbons from an underground reservoir into which at least one vertical well penetrates, comprising:

(a) drilling a substantially horizontal well within the reservoir, said horizontal well intersecting said vertical well; and (b) producing hydrocarbons from either said vertical well or said horizontal well, said producing hydrocarbons comprising:

(i) completing said horizontal well; and (ii) fracturing said horizontal well through the application of fluid pressure from both the vertical well and horizontal well either simultaneously or alternatively.

21. A method for producing hydrocarbons from an underground reservoir into which at least one horizontal well penetrates, comprising:

(a) drilling a substantially vertical well within the reservoir, said vertical well intersecting said horizontal well; and (b) producing hydrocarbons from either said vertical well or said horizontal well, said producing hydrocarbons comprising:

(i) completing said horizontal well; and (ii) fracturing said horizontal well through the application of fluid pressure from both the vertical well and horizontal well either simultaneously or alternatively.

* * * * *